US009098017B2

(12) United States Patent
Hamakawa

(10) Patent No.: US 9,098,017 B2
(45) Date of Patent: Aug. 4, 2015

(54) IMAGE FORMING APPARATUS

(71) Applicant: KYOCERA Document Solutions Inc., Osaka (JP)

(72) Inventor: Hiroyuki Hamakawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/551,996

(22) Filed: Nov. 24, 2014

(65) Prior Publication Data

US 2015/0168873 A1 Jun. 18, 2015

(30) Foreign Application Priority Data

Dec. 12, 2013 (JP) ..... 2013-256831

(51) Int. Cl.
*G03G 15/08* (2006.01)

(52) U.S. Cl.
CPC ..... *G03G 15/0889* (2013.01)

(58) Field of Classification Search
CPC ..... G03G 15/0887–15/0893; G03G 15/0877
See application file for complete search history.

(56) References Cited

U.S. PATENT DOCUMENTS

| | | | | |
|---|---|---|---|---|
| 2009/0317105 | A1* | 12/2009 | Tsutsumi et al. | 399/53 |
| 2010/0260510 | A1* | 10/2010 | Goto | 399/44 |
| 2011/0064435 | A1* | 3/2011 | Takahashi et al. | 399/58 |
| 2012/0177412 | A1* | 7/2012 | Watanabe et al. | 399/256 |
| 2012/0251140 | A1* | 10/2012 | Kubota | 399/44 |

FOREIGN PATENT DOCUMENTS

| | | | | |
|---|---|---|---|---|
| JP | 06051675 A | * | 2/1994 | G03G 21/00 |
| JP | 2001-265098 A | | 9/2001 | |
| JP | 2013-37257 A | | 2/2013 | |

* cited by examiner

*Primary Examiner* — David Gray
*Assistant Examiner* — Sevan A Aydin
(74) *Attorney, Agent, or Firm* — Stein IP, LLC

(57) ABSTRACT

An image forming apparatus has a developing device and a controller. The developing device includes a stirring member, rotatable at a first speed or at a second speed lower than the first speed, which varies, according to its speed, the amount of developer discharged out of the developing device. The controller drives the stirring member to rotate at the second speed, then switches the rotation speed of the stirring member to a third speed higher than the second speed but lower than the first speed, and then drives the stirring member to rotate at the third speed for a first period. The third speed is set higher the lower the fluidity of the developer.

6 Claims, 7 Drawing Sheets

IMAGE FORMING APPARATUS

INCORPORATION BY REFERENCE

This application is based upon and claims the benefit of priority from the corresponding Japanese Patent Application No. 2013-256831 filed on Dec. 12, 2013, the entire contents of which are incorporated herein by reference.

BACKGROUND OF THE INVENTION

The present disclosure relates to image forming apparatuses such as copiers, printers, and facsimile machines as well as multifunction peripherals having their functions integrated together, and more particularly to image forming apparatuses provided with a developing device that is supplied with two-component developer containing toner and carrier while discharging excess developer.

In an image forming apparatus, a latent image is formed on an image carrier such as a photosensitive member, and the latent image is developed by a developing device into a toner image so as to be visible. Some developing devices adopts two-component development using two-component developer. In this type of developing device, two-component developer containing toner and carrier is contained inside a developing container, a developing roller is arranged to feed the developer to the image carrier, and a stirring member is arranged to feed, while stirring and transporting, the developer inside the developing container to the developing roller.

With this developing device, as development operation proceeds, while toner is consumed, the carrier is not consumed but remains inside the developing container. Thus, the carrier stirred with the toner inside the developing container deteriorates as it is stirred repeatedly, and accordingly the carrier gradually loses its ability to electrically charge the toner. As an improvement, a developing device has been proposed in which the developing container is supplied with developer containing carrier while excess developer is discharged with a view to suppressing degradation in chargeability.

For example, a developing device is known in which a stirring member is provided to stir and transport developer inside a developing container, a developer discharge port is provided downstream with respect to the transport direction, and a restricting member is provided between the stirring member and the developer discharge port, the restricting member being formed in a helical shape spiraling in the opposite direction to a helical blade on the stirring member. With this structure, when developer is supplied into the developing container, as the stirring member rotates, the developer is, while being stirred, transported to the downstream side in the transport direction. As the restricting member rotates in the same direction as the stirring member, a transporting force acting in the direction opposite to the direction of transport by the stirring member is applied to the developer. This transporting force acting in the opposite direction causes the developer to stop and bulge on the downstream side in the transport direction, and thus excess developer crosses over the restricting member and moves to the developer discharge port so as to be discharged out of the developing container.

In the developing device described above, so long as the stirring member rotates at a constant speed, a constant amount of developer is discharged through the developer discharge port, and thus the amount of developer inside the developing container is stable. However, in some developing devices, the rotation speed of the stirring member is switchable, in which case, as the rotation speed of the stirring member is switched, the amount of developer discharged through the developer discharge port varies with the rotation speed.

For example, the image formation speed is switched according to type of paper, such as thickness, and print mode, such as high-gloss printing. Also, in a case where a single type of developing device with particular specifications is shared among a plurality of types of image forming apparatuses, for example, the printing speed for an A4-size recording medium varies from one model of image forming apparatus to the other, and thus different image formation speeds need to be set to suit the printing speeds of different models. As the image formation speed is so switched, the rotation speed of the stirring member is accordingly switched, and thus the amount of developer discharged through the developer discharge port varies with the rotation speed of the stirring member.

SUMMARY OF THE INVENTION

According to one aspect of the present disclosure, an image forming apparatus is provided with a developing device and a controller. The developing device is supplied with developer containing toner and carrier while discharging excess developer to outside. The controller controls the developing device. The developing device includes a developer carrier, a stirring member, and a developer discharge portion. The developer carrier carries developer on its surface. The stirring member can rotate at a first speed or at a second speed lower than the first speed. The stirring member feeds the developer stirred and transported inside the developing device to the developer carrier, and varies, according to its rotation speed, the amount of developer discharged out of the developing device. The developer discharge portion discharges excess developer out of the developing device. The controller drives the stirring member to rotate at the second speed, then switches the rotation speed of the stirring member from the second speed to a third speed higher than the second speed but lower than the first speed, and then drives the stirring member to rotate at the third speed for a first period required for the amount of developer in the developing device to fall to a first predetermined amount. The third speed is set higher the lower fluidity of the developer is.

Further features and advantages of the present disclosure will become apparent from the description of embodiments given below.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
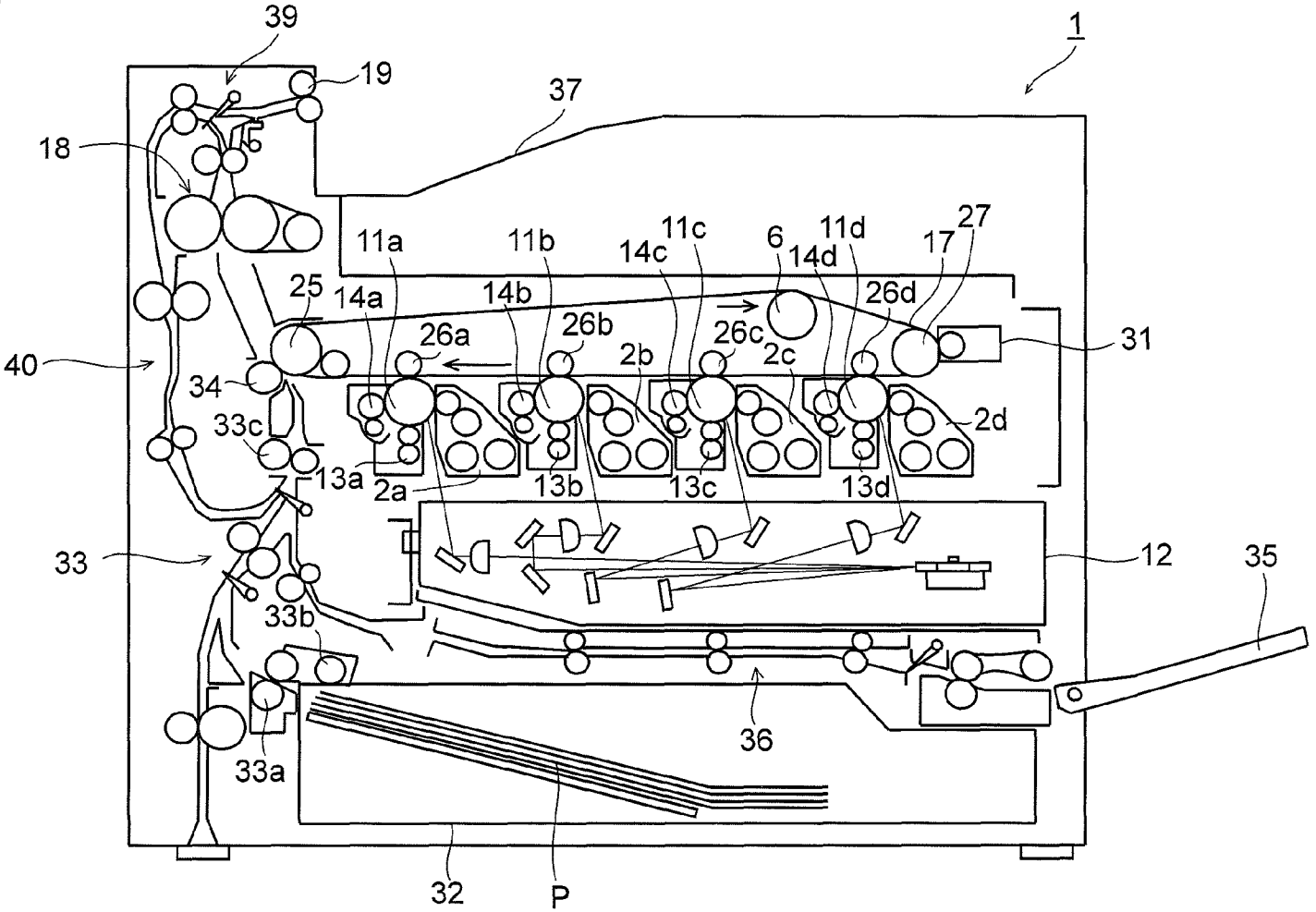
FIG. 1 is a sectional view schematically showing an overall structure of an image forming apparatus according to one embodiment of the present disclosure.

Hereinafter, embodiments of the present disclosure will be described with reference to the accompanying drawings. The embodiments, however, are not meant to limit the present disclosure in any way. Nor are any uses mentioned, terms used, etc. meant to be any limitation to what they specifically refer to in the present disclosure.

With reference to FIGS. 1 to 9, the structure of an image forming apparatus 1 according to one embodiment of the present disclosure will be described. The image forming apparatus 1 according to the embodiment is a tandem-type color printer, and includes rotatable photosensitive members 11*a* to 11*d* each having a photosensitive layer formed of, as a photosensitive material, an organic photosensitive substance (OPC photosensitive substance) and arranged respectively for different colors, namely black, yellow, cyan, and magenta. Around the photosensitive members 11*a* to 11*d*, there are arranged developing devices 2*a* to 2*d*, an exposure unit 12, chargers 13*a* to 13*d*, and cleaning devices 14*a* to 14*d*.

The developing devices 2*a* to 2*d* are arranged respectively to the right of the photosensitive members 11*a* to 11*d* so as to face them, and feed toner to the photosensitive members 11*a* to 11*d*. The chargers 13*a* to 13*d* are arranged respectively on the upstream side of the developing devices 2*a* to 2*d* with respect to the photosensitive member rotation direction so as to face the surfaces of the photosensitive members 11*a* to 11*d*, and electrically charge the surfaces of the photosensitive members 11*a* to 11*d* uniformly.

The exposure unit 12 scans the photosensitive members 11*a* to 11*d* to expose them to light based on image data, such as characters and graphic patterns, fed to an image input section (unillustrated) from a personal computer or the like, and is arranged under the developing devices 2*a* to 2*d*. The exposure unit 12 includes a laser light source and a polygon mirror, and also includes reflecting mirrors and lenses corresponding to the photosensitive members 11*a* to 11*d* respectively. A laser beam emitted from the laser light source is, via the polygon mirror, reflecting mirrors, and lenses, shone on the surfaces of the photosensitive members 11*a* to 11*d* from downstream of the chargers 13*a* to 13*d* with respect to the photosensitive member rotation direction. The laser beam thus shone forms electrostatic latent images on the surfaces of the photosensitive members 11*a* to 11*d* respectively, and these electrostatic latent images are developed into toner images by the developing devices 2*a* to 2*d* respectively.

An endless intermediary transfer belt 17 is wound around a tension roller 6, a driving roller 25, and a driven roller 27. The driving roller 25 is driven to rotate by an unillustrated motor, and the intermediary transfer belt 17 is driven to circulate by the rotation of the driving roller 25.

The photosensitive members 11*a* to 11*d* are arranged under, and in contact with, the intermediary transfer belt 17, one next to the other along its rotation direction (the direction indicated by arrows in FIG. 1). Primary transfer rollers 26*a* to 26*d* are arranged opposite the photosensitive members 11*a* to 11*d*, respectively, across the intermediary transfer belt 17, and are kept in pressed contact with the intermediary transfer belt 17 to form a primary transfer portion. In this primary transfer portion, as the intermediary transfer belt 17 rotates, the toner images on the photosensitive members 11*a* to 11*d* are transferred to the intermediary transfer belt 17 successively with predetermined timing. Thus, on the surface of the intermediary transfer belt 17, a toner image is formed which has toner images of four colors, namely magenta, cyan, yellow, and black, overlaid together.

A secondary transfer roller 34 is arranged opposite the driving roller 25 across the intermediary transfer belt 17, and is kept in pressed contact with the intermediary transfer belt 17 to form a secondary transfer portion. In this secondary transfer portion, the toner image on the surface of the intermediary transfer belt 17 is transferred to paper (recording medium) P. After the transfer, a belt cleaning device 31 removes the toner that has remained on the intermediary transfer belt 17.

In a lower part inside the image forming apparatus 1, a paper feed cassette 32 is arranged which contains sheets of paper P. To the right of the paper feed cassette 32, a stack tray 35 is arranged which feeds hand-fed sheets of paper P. To the left of the paper feed cassette 32, a first paper transport passage 33 is arranged through which the paper P fed out of the paper feed cassette 32 is transported to the secondary transfer portion. To the left of the stack tray 35, a second paper transport passage 36 is arranged through which the paper P fed out of the stack tray 35 is transported to the secondary transfer portion. In an upper left part of the image forming apparatus 1, there are arranged a fusing section 18 which performs fusing on the paper P having the toner image formed on it and a third paper transport passage 39 through which the paper P having undergone the fusing to a paper discharge portion 37.

The paper feed cassette 32 can be replenished with paper P when drawn out of the apparatus (frontward of the plane of FIG. 1). The paper P contained in the paper feed cassette 32 is fed out, sheet by sheet, toward the first paper transport passage 33 by a pickup roller 33*b* and a separating roller pair 33*a*.

The first and second paper transport passages 33 and 36 meet closely upstream of a registration roller pair 33*c*. The registration roller pair 33*c* coordinates timing between image formation and paper feeding at the intermediary transfer belt 17, and transports the paper P to the secondary transfer portion. To the paper P transported to the secondary transfer portion, the toner image on the intermediary transfer belt 17 is transferred by a second transfer roller 34 to which a bias potential is applied, and the paper P is then transported on to a fusing section 18.

The fusing section 18 includes a fusing belt which is heated by a heater, a fusing roller which is kept in contact with the fusing belt from inside, a pressing roller which is arranged in pressed contact with the fusing roller across the fusing belt, etc. The fusing section 18 performs fusing by heating and pressing the paper P having an unfused toner image transferred to it. Having the toner image fused on it by the fusing section 18, the paper P is reversed, as necessary, in a fourth paper transport passage 40 so that a toner image is secondarily transferred also to the reverse side of the paper P by the second transfer roller 34 and is fused by the fusing section 18. The paper P having the toner image fused to it is transported through the third paper transport passage 39 and is discharged onto the paper discharge portion 37 by a discharge roller pair 19.

Next, with reference to FIG. 2, the structure of the developing device 2*a* will be described in detail. The following description deals with the structure and operation of the developing device 2*a* corresponding to the photosensitive member 11*a* shown in FIG. 1 and no overlapping description will be repeated for the developing devices 2*b* to 2*d*, which are structured, and operate, in a similar manner to the developing device 2*a*; also, the suffixes "a" to "d" distinguishing the developing devices and photosensitive members of different colors will be omitted.

Figure 2:
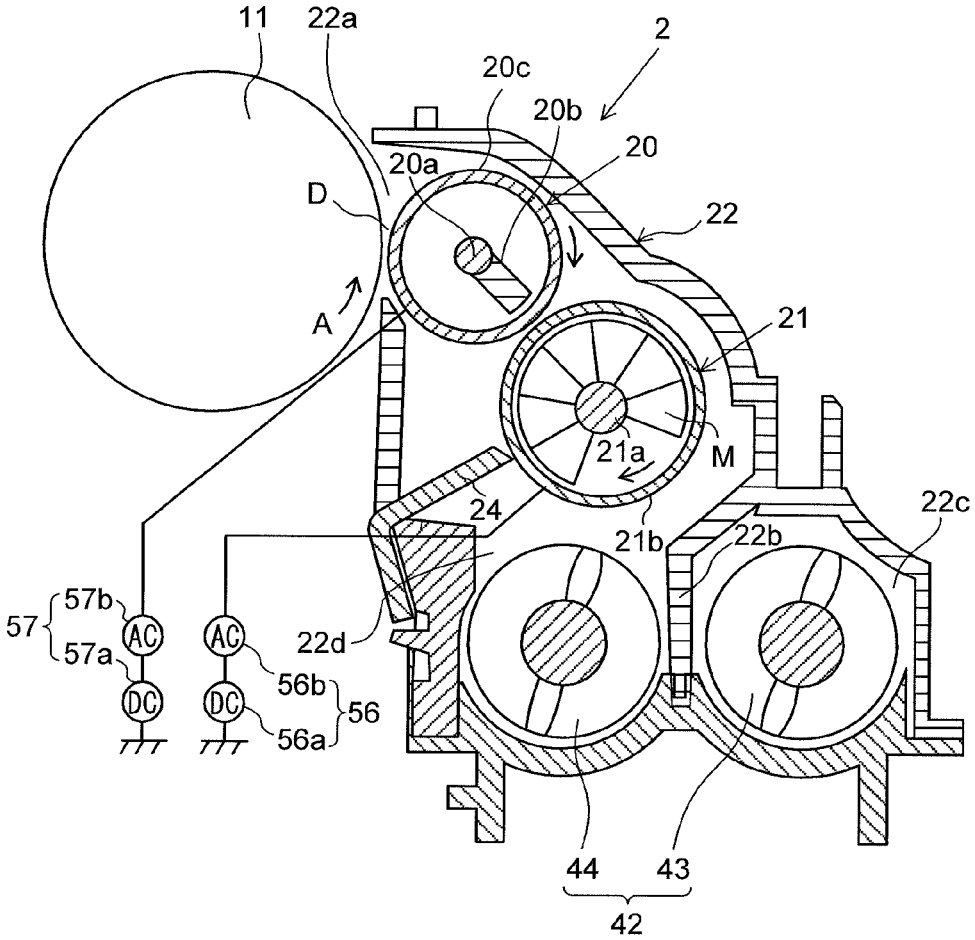
FIG. 2 is a sectional side view showing a structure of a developing device in an image forming apparatus according to one embodiment of the present disclosure.

As shown in FIG. 2, the developing device 2 is composed of a developing roller (developer carrier) 20, a magnetic roller 21, a restricting blade 24, a stirring member 42, a developing container 22, etc.

The developing container 22 forms a resin outer shell of the developing device 2, and a lower part of the developing container 22 is divided into a first transport passage 22*c* and a second transport passage 22*d* by a partition 22*b*. In the first and second transport passages 22*c* and 22*d*, two-component developer containing magnetic carrier and toner is contained. The developing container 22 rotatably holds the stirring member 42, the magnetic roller 21, and the developing roller 20. In the developing container 22, an opening 22*a* is formed through which the developing roller 20 is exposed toward the photosensitive member 11.

The developing roller 20 faces the photosensitive member 11, and is arranged to the right of the photosensitive member 11 at a predetermined distance. The developing roller 20 forms, in its part closely facing the photosensitive member 11, a developing region D where toner is fed to the photosensitive member 11. The magnetic roller 21 faces the developing roller 20 at a predetermined distance, and is arranged to the lower right of the developing roller 20. The magnetic roller 21 feeds, in its part closely facing the developing roller 20, toner to the developing roller 20. The restricting blade 24 is, at the lower left of the magnetic roller 21, stationarily held on the developing container 22. The stirring member 42 is arranged substantially under the magnetic roller 21.

The stirring member 42 is composed of two members, namely a first stirring member 43 and a second stirring member 44. The second stirring member 44 is arranged under the magnetic roller 21, inside the second transport passage 22*d*. The first stirring member 43 is arranged closely to the right of the second stirring member 44, inside the first transport passage 22*c*.

The first and second stirring members 43 and 44 stir the developer and thereby electrically charge the toner contained in the developer to a predetermined potential level. This permits the toner to be held on the magnetic carrier. In longitudinal-direction opposite end parts of the partition 22*b* (the direction being the front/rear direction with respect to the plane of FIG. 2), which partitions between the first and second transport passages 22*c* and 22*d*, there are respectively provided communicating portions (unillustrated) so that, as the first stirring member 43 rotates, the electrically charged developer is transported through one of the communication portions provided in the partition 22*b* into the second transport passage 22*d* so as to circulate through the first and second transport passages 22*c* and 22*d*. The developer is then fed from the second stirring member 44 to the magnetic roller 21.

The magnetic roller 21 includes a roller shaft 21*a*, a magnetic-pole member M, and a rotary sleeve 21*b* formed of a non-magnetic material. The magnetic roller 21 carries the developer fed from the second stirring member 44, and feeds, out of the developer it carries, only the toner to the developing roller 20. The magnetic-pole member M is composed of a plurality of magnets which each have a fan-shaped cross section and which have different magnetic poles at their outer circumferential part, and is firmly fitted to the roller shaft 21*a* with adhesive or otherwise. The roller shaft 21*a* is non-rotatably fixed inside the rotary sleeve 21*b*, and the magnetic-pole member M is non-rotatably supported on the developing container 22 at a predetermined distance from the rotary sleeve 21*b*. The rotary sleeve 21*b* rotates in the direction indicated by an arrow (in the clockwise direction) by the action of a drive mechanism including a motor and a gear, unillustrated, and a bias 56 having an alternating-current voltage 56*b* superimposed on a direct-current voltage 56*a* is applied to the rotary sleeve 21*b*. On the surface of the rotary sleeve 21*b*, the electrically charged developer is carried while forming a magnetic brush under the magnetism of the magnetic-pole member M, and the magnetic brush is adjusted to have a predetermined height by the restricting blade 24.

As the rotary sleeve 21*b* rotates, the magnetic brush is transported by being carried on the surface of the rotary sleeve 21*b*; when, at a magnetic-pole member 20*b* provided on the developing roller 20, the magnetic brush rises and makes contact with the developing roller 20, only the toner out of the magnetic brush is fed to the developing roller 20 according to the bias 56 applied to the rotary sleeve 21*b*.

The developing roller 20 is composed of a stationary shaft 20*a*, a magnetic-pole member 20*b*, a developing sleeve 20*c* formed of a non-magnetic metal material in a cylindrical shape, etc.

The stationary shaft 20*a* is non-rotatably supported on the developing container 22. On the stationary shaft 20*a* is rotatably held the developing sleeve 20*c*, and to the stationary shaft 20*a* is firmly fitted, with adhesive or otherwise, the magnetic-pole member 20*b*, which comprises a magnet, at a position where it faces the magnetic roller 21, at a predetermined distance from the developing sleeve 20*c*. The developing sleeve 20*c* is rotated in the direction indicated by an arrow in FIG. 2 (in the clockwise direction) by a drive mechanism comprising a motor and a gear, unillustrated. A developing bias 57 having an alternating-current voltage 57*b* superimposed on a direct-current voltage 57*a* is applied to the developing sleeve 20*c*.

When the developing bias 57 is applied to the developing sleeve 20*c*, the potential difference between the developing bias potential and the potential in the exposed part of the photosensitive member 11 causes the toner carried on the surface of the developing sleeve 20*c* to fly toward the photosensitive member 11 in the developing region D. The flying toner successively adheres to the exposed part of the photosensitive member 11 rotating in the direction indicated by arrow A (in the counter-clockwise direction), and thereby develops the electrostatic latent image on the photosensitive member 11.

Figure 3:
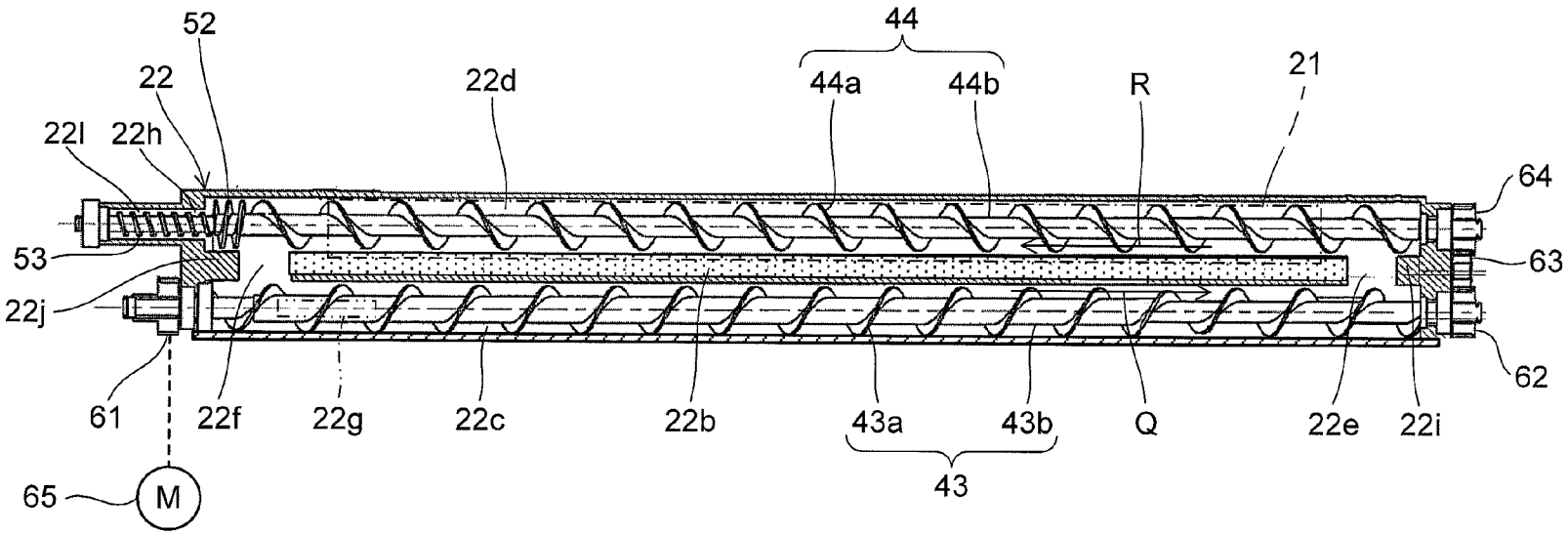
FIG. 3 is a sectional plan view showing a structure of a lower part of a developing device in an image forming apparatus according to one embodiment of the present disclosure.

Next, with reference to FIG. 3, the stirring section will be described in detail.

As described above, in the developing container 22 are formed the first transport passage 22*c*, the second transport passage 22*d*, the partition 22*b*, the upstream-side communicating portion 22*e*, and the downstream-side communicating portion 22*f*; also formed there are a developer supply port 22*g*, a developer discharge port 22*h*, an upstream-side wall 22*i*, and a downstream-side wall 22*j*.

The partition 22*b* extends in the longitudinal direction of the developing container 22, and partitions between the first and second transport passages 22*c* and 22*d* such that these lie side by side. At opposite end parts of the partition 22*b* in its longitudinal direction, the upstream-side and downstream-side communicating portions 22*e* and 22*f* are provided, so that the developer can circulate through the first transport passage 22*c*, the upstream-side communicating portion 22*e*, the second transport passage 22*d*, and the downstream-side communicating portion 22*f*.

The developer supply port 22*g* is an opening through which to feed new toner and magnetic carrier from a developer container (unillustrated) provided over the developing container 22 into the developing container 22, and is arranged in an upstream part (to the left in FIG. 3, indicated by a dash-dot-dot line) of the first transport passage 22*c*.

The developer discharge port 22*h* is an opening through which to discharge excess developer inside the first and second transport passages 22*c* and 22*d* that grows as a result of developer being fed in through the developer supply port 22*g*, and is provided in a downstream part, in a side face, of the second transport passage 22*d*.

Inside the first transport passage 22*c*, the first stirring member 43 is arranged, and inside the second transport passage 22*d*, the second stirring member 44 is arranged.

The first stirring member 43 has a rotary shaft 43*b*, and a first helical blade 43*a* which is formed integrally with the rotary shaft 43*b* and which is formed in a helical shape with a predetermined pitch in the axial direction of the rotary shaft 43*b*. The first helical blade 43*a* extends up to opposite end parts of the first transport passage 22*c* in its longitudinal direction, and faces the upstream-side and downstream-side communicating portions 22*e* and 22*f*. The rotary shaft 43*b* is rotatably pivoted on the upstream-side and downstream-side walls 22*i* and 22*j*.

The second stirring member 44 has a rotary shaft 44*b*, and a second helical blade 44*a* which is formed integrally with the rotary shaft 44*b* and which is formed in a helical shape having the same pitch as, but spiraling in the opposite direction to, the first helical blade 43*a* in the axial direction of the rotary shaft 44*b*. The second helical blade 44*a* has a length greater than the length of the magnetic roller 21 in its axial direction, and faces the upstream-side and downstream-side communicating portions 22*e* and 22*f*. The rotary shaft 44*b* is arranged parallel to the rotary shaft 43*b*, and is rotatably pivoted on the upstream-side and downstream-side walls 22*i* and 22*j*.

Arranged integrally on the rotary shaft 44*b* along with the second helical blade 44*a* are a reverse helical blade 52 and a discharge blade 53 for restricting the amount of developer discharged.

The reverse helical blade 52 faces the developer discharge port 22*h*, and is arranged between the developer discharge port 22*h* and the second helical blade 44*a*. The outer edge of the reverse helical blade 52 is located at a predetermined distance from the inner circumferential face of the second transport passage 22*d* on the downstream-side wall 22*j*. The reverse helical blade 52 is formed in a helical shape having substantially the same outer circumferential length as the outer edge of the second helical blade 44*a* and spiraling in the opposite direction (having the opposite phase) to the second helical blade 44*a*, and is a two- to three-turn helical blade having a smaller pitch than the second helical blade 44*a*. Accordingly, as the rotary shaft 44*b* rotates, the reverse helical blade 52 exerts to the developer a transporting force acting in the opposite direction to the direction of developer transport by the second helical blade 44*a*, and thus the developer is blocked. The developer thus blocked either is transported to the downstream-side communicating portion 22*f* or, as excess developer inside the developing container 22, crosses over the outer edge of the reverse helical blade 52 to be discharged to the developer discharge port 22*h*.

The rotary shaft 44*b* extends beyond the developer discharge port 22*h* into a developer discharge portion 22*l*, and inside the developer discharge portion 22*l*, the discharge blade 53 is provided on the rotary shaft 44*b*. The discharge blade 53 is in a helical shape having the same phase direction as the second helical blade 44*a*, but has a smaller pitch and a smaller outer edge size than the second helical blade 44*a*. As the rotary shaft 44*b* rotates, the discharge blade 53 rotate together, so that the excess developer collected through the developer discharge port 22*h* in the developer discharge portion 22*l* is transported leftward inside the developer discharge portion 22*l* so as to be discharged out of the developing container 22.

On the outer faces of the upstream-side and downstream-side walls 22*i* and 22*j*, gears 61 to 64 are arranged. The gears 61 and 62 are firmly fitted to the rotary shaft 43*b*, the gear 64 is firmly fitted to the rotary shaft 44*b*, and the gear 63 is rotatably held on the upstream-side wall 22*i* and meshes with the gears 62 and 64. The gear 61 is driven to rotate by a stirring motor 65 via an unillustrated gear train.

The stirring motor 65 is also coupled with predetermined gear trains of the developing roller 20 (see FIG. 2), the magnetic roller 21, and the photosensitive member 11 respectively. During image formation, as the stirring motor 65 is driven to rotate, the photosensitive member 11, the developing roller 20, and the magnetic roller 21 rotate, and the first and second stirring members 43 and 44 rotate together. The rotation speed of the stirring motor 65 is switched according to type of the paper to print on, print mode, or printing speed.

As the stirring motor 65 is driven to rotate, and thus the gear 61 rotates, the rotary shaft 43*b* rotates, and the first helical blade 43*a* rotates together, so that the first helical blade 43*a* transports the developer inside the first transport passage 22*c* in the direction indicated by arrow Q. Moreover, via the gear train of the gears 62 to 64, as the rotary shaft 44*b* rotates, the second helical blade 44*a* rotates together, so that the second helical blade 44*a* transports the developer inside the second transport passage 22*d* in the direction indicated by arrow R. Thus, the developer is stirred while circulating through the first transport passage 22*c*, the upstream-side communicating portion 22*e*, the second transport passage 22*d*, and the downstream-side communicating portion 22*f*. The developer thus stirred is fed to the magnetic roller 21.

Next, a description will be given of the supply and discharge of developer to and from the developing container 22. It is here assumed that the developer inside the developing device 2 contains about 10% of toner to carrier, with the toner adhered around the carrier. On the other hand, the refill developer (the developer supplied through the developer supply port 22*g*) contains about 10% of carrier, with the carrier dispersed in the toner.

As toner is consumed in development, developer containing toner and magnetic carrier is supplied through the developer supply port 22*g* into the developing container 22. The developer is supplied according to printing ratio of the image to be printed and paper size. How the developer supply amount (the amount of developer supplied to the developing device 2) is controlled will be discussed later.

The supplied developer is stirred while being transported through first transport passage 22*c*, the upstream-side communicating portion 22*e*, the second transport passage 22*d*, and the downstream-side communicating portion 22*f*, while excess developer inside the developing container 22 crosses over the reverse helical blade 52 to be discharged to the developer discharge port 22*h*. Thus, the developing container 22 always contains an adequate amount of developer, preventing uneven feeding from the second stirring member 44 to magnetic roller 21, thus allowing stable, uniform feeding to the magnetic roller 21.

Today, a developer 2 with particular specifications is often universally used in various image forming apparatuses. For example, in a case where a developing device 2 that is customarily used in high-speed apparatuses is used in low-speed apparatuses, since low-speed apparatuses operate at lower printing speed than the high-speed apparatuses, the image formation speed needs to be reduced, and accordingly the first and second stirring members 43 and 44 rotate at lower speed.

Figure 4:
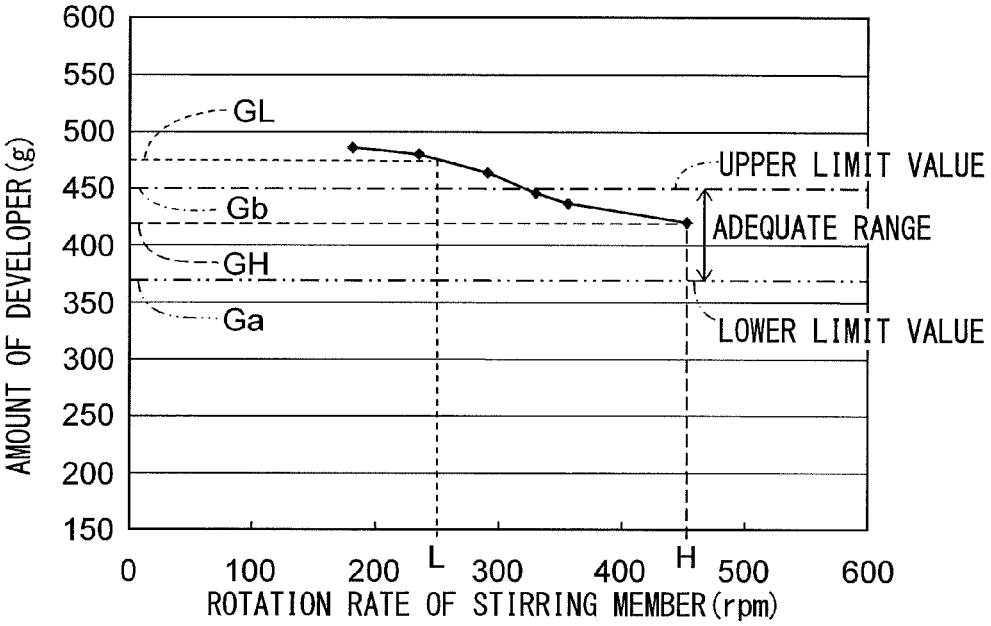
FIG. 4 is a diagram showing a relationship between the rotation rate of a stirring member and the amount of developer inside a developing container in an image forming apparatus according to one embodiment of the present disclosure.

As the rotation speed of the first and second stirring members 43 and 44, in particular the rotation speed of the second stirring member 44 arranged closer to the developer discharge port 22*h*, is switched, the amount of developer discharged through the developer discharge port 22*h* varies as shown in FIG. 4. FIG. 4 shows variation of the amount of developer inside the developing container 22 plotted against the rotation rate of the second stirring member 44, the horizontal axis representing the rotation rate (in rpm, i.e., revolutions per minute) of the second stirring member 44, the vertical axis representing the amount of developer (in grams) inside the developing container 22. Here, the maximum value of the rotation rate of the second stirring member 44 is 560 rpm (first speed).

As shown in FIG. 4, when the rotation rate of the second stirring member 44 is low, as compared with when the rotation rate of the second stirring member 44 is high, a smaller amount of developer is discharged through the developer discharge port 22*h*, and accordingly a larger amount of developer is present inside the developing container 22.

When the amount of developer inside the developing container 22 is, for example, within the range from amount Ga to amount Gb, the developing device 2 with the particular specifications provides a satisfactory image. However, when the amount of developer inside the developing container 22 falls below amount Ga, the drop in the amount of developer fed to the magnetic roller 21 causes partial blanking in the image, and uneven feeding of developer to the magnetic roller 21 causes an uneven image. On the other hand, when the amount of developer inside the developing container 22 exceeds amount Gb, the amount of developer fed to the magnetic roller 21 is so large as to make it difficult for the developer to separate from the magnetic roller 21, resulting in lower image density. In a case where the developing device 2 is used in a high-speed image forming apparatus 1, the amount of developer inside the developing container 22 is within the range from amount Ga to amount Gb. However, in a case where the developing device 2 is used in a low-speed image forming apparatus 1, since the rotation rate of the second stirring member 44 is low, the amount of developer inside the developing container 22 exceeds amount Gb, possibly leading to a defect in the image.

Specifically, when the developing device 2 is used in a high-speed image forming apparatus 1, the rotation speed of the second stirring member 44 corresponding to the printing speed of a high-speed apparatus is set at rotation rate H (third speed) shown in FIG. 4. As toner is consumed in development, developer is supplied, and even if excess developer is present inside the developing container 22, as the second stirring member 44 is rotated at rotation rate H, developer is discharged from the developing container 22, so that the amount of developer inside the developing container 22 remains stable at amount GH. Amount GH lies in the range (adequate range) from amount Ga to amount Gb, and thus the high-speed image forming apparatus 1 produces a satisfactory image.

However, when the developing device 2 mentioned above is used in a low-speed image forming apparatus 1, the rotation speed of the second stirring member 44 corresponding to the printing speed of a low-speed apparatus is set at rotation rate L (second speed). Rotation rate L is lower than rotation rate H. As toner is consumed in development, developer is supplied, and excess developer inside the developing container 22 is discharged from the developing container 22 by the second stirring member 44 rotating at rotation rate L, and thus the amount of developer inside the developing container 22 remains stable at amount GL. Amount GL lies above the maximum amount of developer (upper limit value) Gb of the adequate range in which a satisfactory image is obtained; thus, a large amount of developer remains inside the developing container 22, leading to a defect in the image, such as lower image density.

Figure 5:
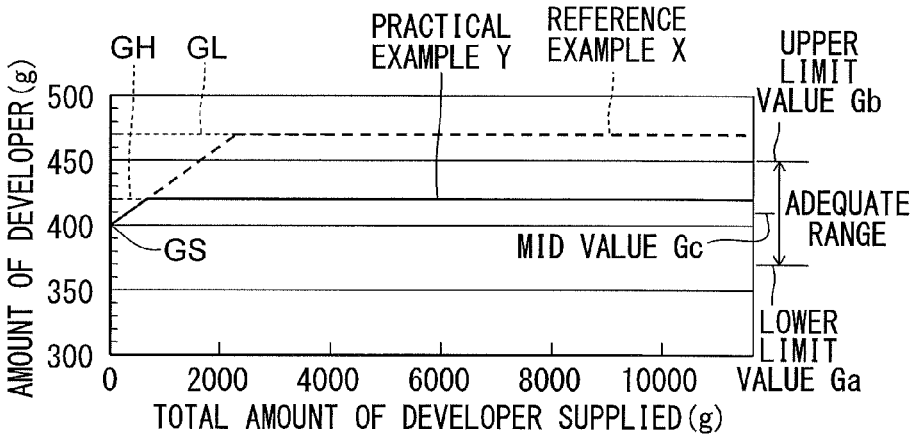
FIG. 5 is a diagram showing a relationship between the total amount of developer supplied and the amount of developer inside a developing container in an image forming apparatus according to one embodiment of the present disclosure.
Figure 6:
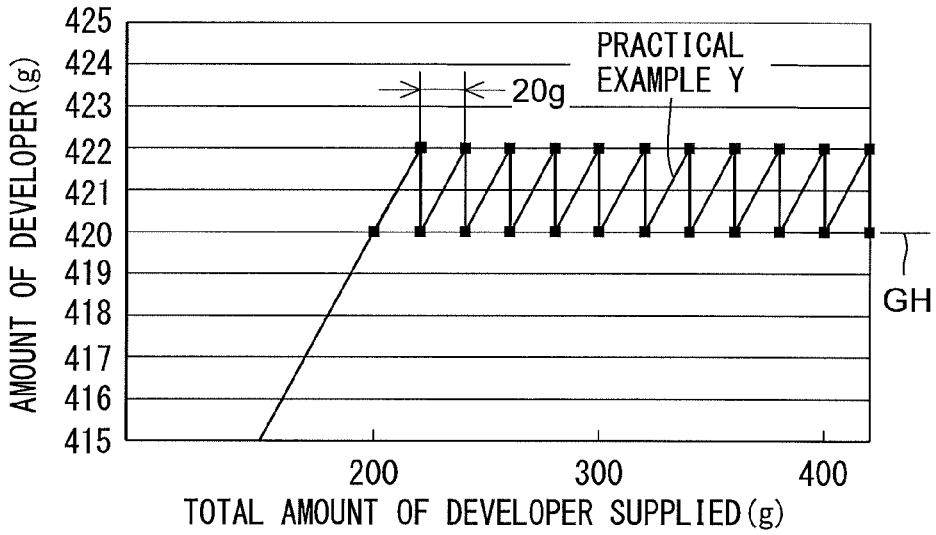
FIG. 6 is a diagram showing a relationship between the total amount of developer supplied and the amount of developer inside a developing container in an image forming apparatus according to one embodiment of the present disclosure.

To avoid that, when the developing device 2 is used in a low-speed apparatus, the amount of developer inside the developing container 22 is controlled as shown in FIG. 5. FIGS. 5 and 6 are plots showing that, as the amount of developer inside the developing container 22 is controlled according to the total amount of developer supplied, the amount of developer inside the developing container 22 varies, with respect to Reference Example X and Practical Example Y. In the diagrams, the horizontal axis represents the total amount of developer (in grams) supplied, and the vertical axis represents the amount of developer (in grams) inside the developing container 22.

In Reference Example X shown in FIG. 5, to cope with the printing speed of a low-speed apparatus, the rotation speed of the second stirring member 44 is set at rotation rate L (for example, 250 rpm), and the developing container 22 contains an amount of developer GS (here, about 400 g) which is equal to or larger than the minimum amount of developer Ga (lower limit value; here, about 370 g) but equal to or smaller than the maximum amount of developer Gb (higher limit value; here, about 450 g) in the initial state of the developing device 2 (in a brand-new developing device 2). Amount GS is an amount smaller than the mid value Gc (=(Ga+Gb)/2) of the adequate range of the amount of developer inside the developing device 2 but equal to or larger than the lower limit value Ga, and the amount of developer inside a brand-new developing device 2 equals GS. After the start of image formation, as toner is consumed in development, developer is supplied to the developing container 22 according to the printing ratio on and the paper size of printed paper P, while developer is discharged through the developer discharge port 22*h*. Since the rotation speed of the second stirring member 44 is set at rotation rate L, until the amount of developer reaches a predetermined amount, no developer is discharged; as the number of prints increases, the amount of developer inside the developing container 22 gradually increases; when rotation driving has been continued to reach a predetermined number of sheets, the amount of developer inside the developing container 22 becomes stable at amount GL (here, about 470 g). Amount GL lies above the upper limit value Gb of the adequate range, and thus printing over a predetermined number of sheets suffers from a defect in the image such as low image density.

By contrast, in Practical Example Y, to cope with the printing speed of a low-speed apparatus, the rotation speed of the second stirring member 44 is set at rotation rate L (for example, 250 rpm), and the developing container 22 contains, as in the Reference Example X, an amount GS (about 400 g) of developer. After the start of image formation, as toner is consumed in development, developer is supplied to the developing container 22 according to the printing ratio on and the paper size of the printed paper P. Since the rotation speed of the second stirring member 44 is set at rotation rate L, until the amount of developer reaches a predetermined amount, no developer is discharged; as the number of prints increases, the amount of developer inside the developing container 22 gradually increases. Thus, the second stirring member 44 starts to be driven to rotate with its rotation speed at rotation rate L, and when the total amount of developer supplied has reached a predetermined amount (or the amount of developer inside the developing device 2 has reached a predetermined amount), the rotation speed of the second stirring member 44 is switched from rotation rate L to rotation rate H (for example, about 450 rpm), and then the second stirring member 44 is driven to rotate at rotation rate H for a period (first period) until the amount of developer inside the developing container 22 falls to amount GH. This control is repeated so that the amount of developer inside the developing container 22 stays in the range from the mid value Gc of the adequate range to the upper limit value Gb, and this prevents a defect in the image due to increased developer as occurs in Reference Example X.

To allow the amount of developer inside the developing container 22 to stay in the range from the mid value Gc of the adequate range to the upper limit value Gb, the developing device 2 and the image forming apparatus 1 are configured as described above.

The amount of developer inside the developing device 2 before developer is discharged from the developing device 2 as the second stirring member 44 is driven to rotate with its rotation speed at rotation rate H equals GH. This amount GH is equal to or larger than the mid value Gc of the adequate range but smaller than the upper limit value Gb. In other words, even when the second stirring member 44 is driven to rotated with its rotation speed at rotation rate H, until the amount of developer inside the developing device 2 reaches GH (here, about 420 g), no developer is discharged. The increase in the amount of developer inside the developing device 2 is approximately equal to the increase in the amount of carrier. Thus, assuming that the concentration of the carrier in the developer supplied through the developer supply port 22*g* is about 10%, then it is advisable, when (or before) the total amount of developer supplied reaches about 200 g (≈(420 g−400 g)/0.1), to switch the rotation speed of the second stirring member 44 from rotation rate L to rotation rate H and perform developer discharge operation to forcibly discharge excess developer. In the embodiment, after the total amount of developer supplied has reached 200 g, the developer discharge operation is started. Assuming that the paper size is A4, the printing ratio is about 5%, and the amount of toner consumed per A4 sheet is about 20 mg, then the total amount of developer supplied reaches 200 g about when the number of prints reaches 10,000. At this point, the amount of developer inside the developing device 2 is equal to or larger than the mid value Gc of the adequate range but equal to or smaller than the upper limit value Gb.

Figure 7:
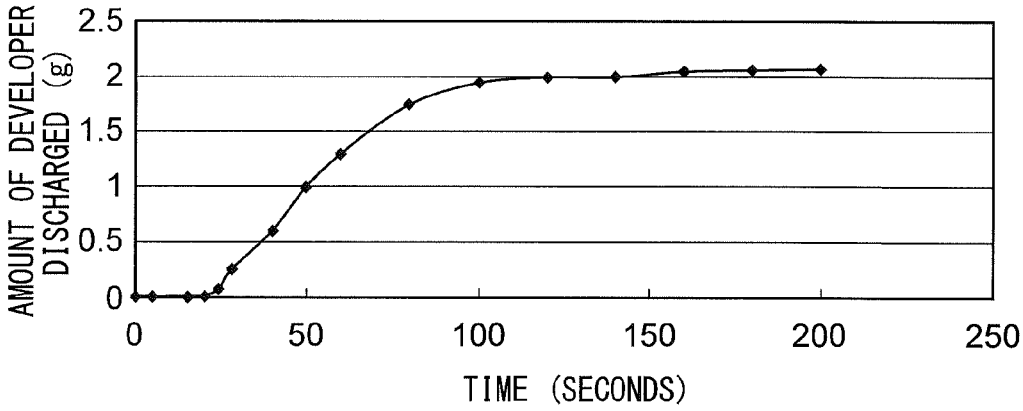
FIG. 7 is a diagram showing a relationship between the rotation driving time and the amount of developer discharged when a stirring member is rotated at a third speed in an image forming apparatus according to one embodiment of the present disclosure.

Thereafter, each time the total amount of developer supplied increases by 20 g (each time a second period elapses), the rotation speed of the second stirring member 44 is switched from rotation rate L to rotation rate H, and for a period until the amount of developer inside the developing container 22 falls to amount GH, the second stirring member 44 is driven to rotate at rotation rate H. An increase of 20 g in the total amount of developer supplied corresponds to an increase of about 2 g (≈20 g×0.1) in the amount of developer inside the developing container 22. Here, as shown in FIG. 7, in a case where the amount of developer inside the developing container 22 is about 422 g, by rotating the second stirring member 44 with its rotation speed at rotation rate H, it is possible to discharge about 2 g of developer in a period of about 100 seconds. Thus, the amount of developer inside the developing container 22 stays in the range from about 420 g to about 422 g. Assuming that the paper size is A4, the printing ratio is about 5%, and the amount of toner consumed per A4 sheet is 20 mg, then for the total amount of developer supplied to increase by 20 g, about 1,000 sheets need to be printed.

However, when the developer comes to have low fluidity, the relationship between the rotation rate of the second stirring member 44 and the amount of developer inside the developing container 22 is not like the one shown in FIG. 4. Specifically, as shown in Table 1 (a third reference table 83, which will be described later), in a standard-temperature, standard-humidity ambience (here, 23° C., 60% RH), the absolute humidity is about 10.3 g/m$^3$, and the bulk density of the developer is about 1.79 g/cm$^3$. In a summer ambience (here, 28° C., 80% RH), the absolute humidity is about 21.8 g/m$^3$, and the bulk density of the developer is about 1.62 g/cm$^3$. In a high-temperature, high-humidity ambience (here, 32° C., 80% RH), the absolute humidity is about 27.8 g/m$^3$, and the bulk density of the developer is about 1.56 g/cm$^3$. Here, bulk density is an index of fluidity, and the smaller a bulk density value, the lower the fluidity. That is, the higher the absolute humidity, the lower the bulk density of the developer, and thus the lower the fluidity of the developer.

TABLE 1

| Ambience (Temperature & Humidity) | Standard-Temperature, Standard-Humidity (23° C., 60% RH) | Summer Ambience (28° C., 80% RH) | High-Temperature, High-Humidity (32° C., 80% RH) |
|---|---|---|---|
| Absolute Humidity (g/m$^3$) | 10.3 | 21.8 | 27.8 |
| Bulk Density (g/cm$^3$) | 1.79 | 1.62 | 1.56 |
| Rotation Rate (rpm) | 450 | 500 | 550 |

Figure 8:
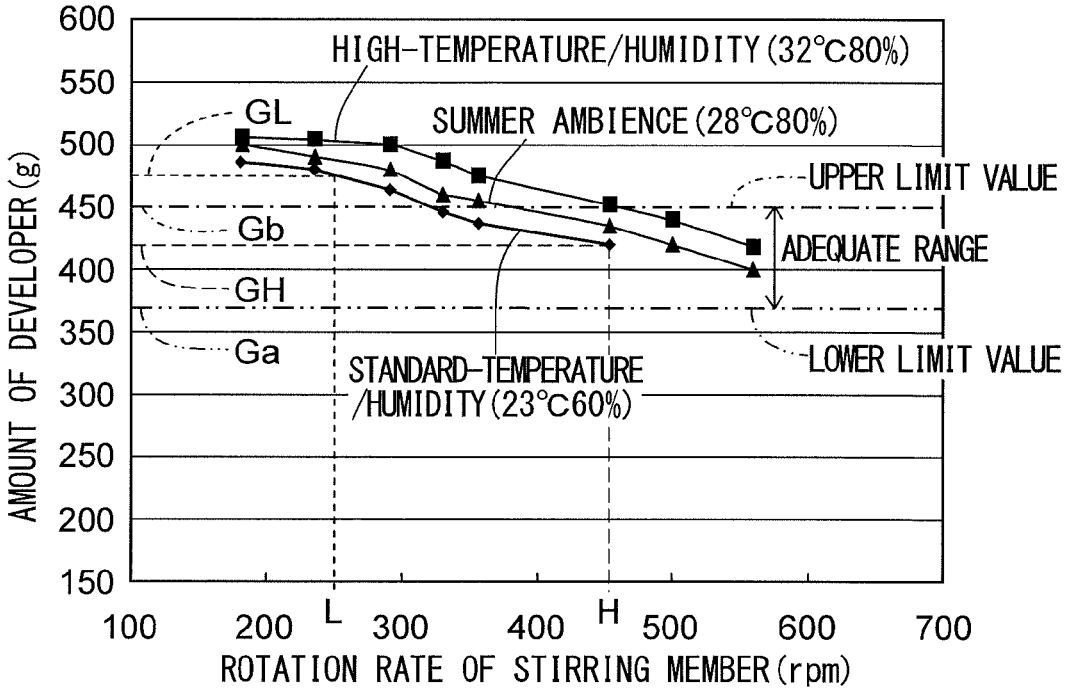
FIG. 8 is a diagram showing a relationship between the rotation rate of a stirring member and the amount of developer inside a developing container in an image forming apparatus according to one embodiment of the present disclosure, as observed in each of a normal-temperature, normal-humidity ambient, a summer ambient, and a high-temperature, high-humidity ambient.

The lower the fluidity of the developer, the poorer the discharge properties of the developer; thus, the relationship between the rotation rate of the second stirring member 44 and the amount of developer inside the developing container 22 is as shown in plots in FIG. 8. There, the relationship between the rotation rate of the second stirring member 44 and the amount of developer inside the developing container 22 in a standard-temperature, standard-humidity ambience, a summer ambience, and a high-temperature, high-humidity ambience is indicated by diamonds, triangles, and squares respectively.

As shown in FIGS. 4 and 8, when the rotation speed of the second stirring member 44 is switched from about 250 rpm (rotation rate L) to about 450 rpm (rotation rate H) in a standard-temperature, standard-humidity ambience, the amount of developer inside the developing container 22 falls to about 420 g (amount GH). However, as shown in FIG. 8, even when the rotation speed of the second stirring member 44 is switched from about 250 rpm (rotation rate L) to about 450 rpm (rotation rate H) in a summer ambience or in a high-temperature, high-humidity ambience, the amount of developer inside the developing container 22 only falls to about 435 g or about 455 g respectively. Thus, to make the amount of developer inside the developing container 22 fall down to about 420 g (amount GH) in a summer ambience or in a high-temperature, high-humidity ambience, the rotation speed of the second stirring member 44 is switched from about 250 rpm (rotation rate L) to about 500 rpm (rotation rate H) or about 550 rpm (rotation rate H) respectively. That is, rotation rate H (third speed) is corrected to be higher the lower the fluidity of the developer.

When the developing device 2 is replaced with a brand-new one, the calculated value of the total amount of developer supplied is reset.

Next, how the image forming apparatus 1 is controlled will be described.

Figure 9:
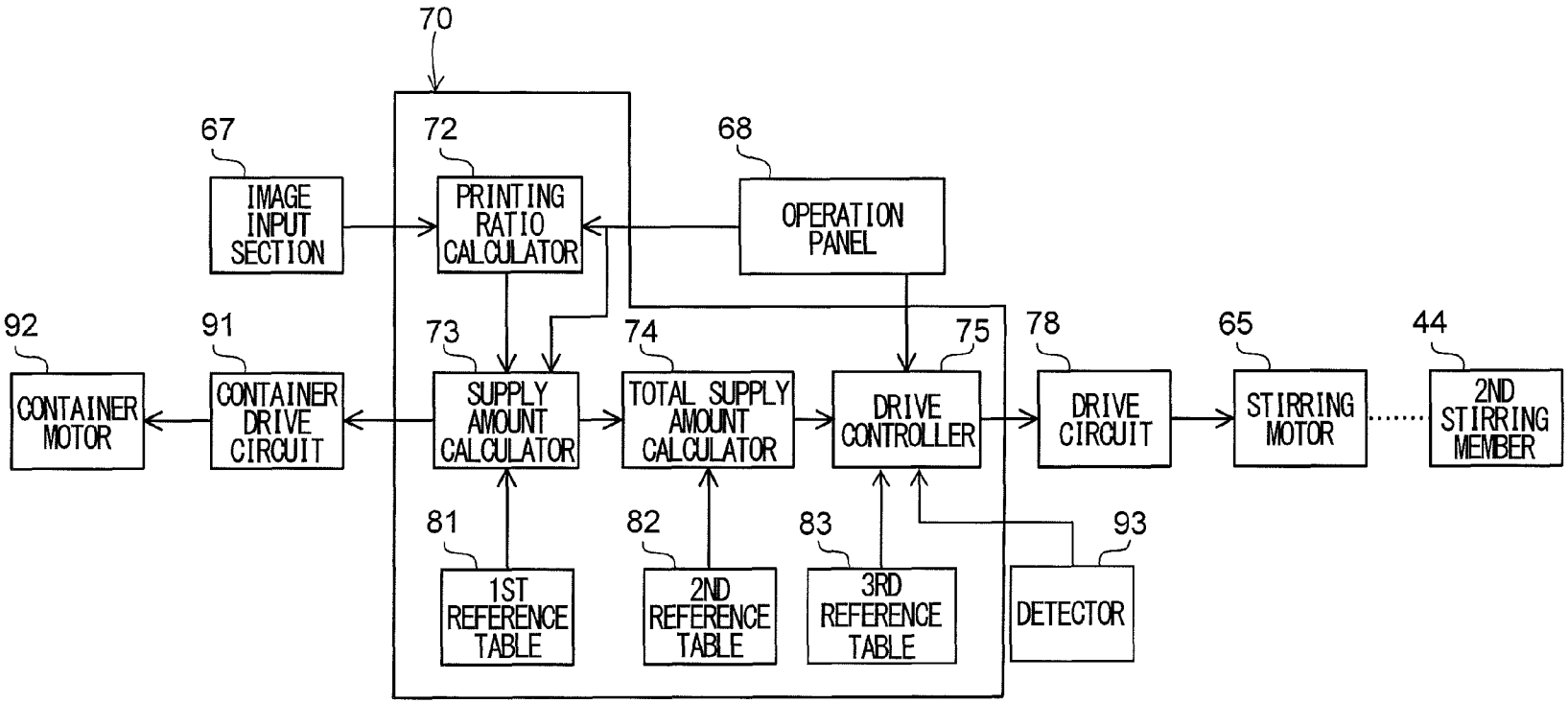
FIG. 9 is a block diagram showing control paths for driving stirring members in an image forming apparatus according to one embodiment of the present disclosure.

The driving time and the rotation speed of the second stirring member 44 are controlled through control paths as shown in FIG. 9. A controller 70 controls the amount of developer supplied to the developing device 2 according to the printing ratio of an image to be printed, and performs image formation by controlling the amount of developer inside the developing device 2 within an adequate range. Around the controller 70, there are provided a drive circuit 78 for driving the stirring motor 65, a container drive circuit 91 for driving a container motor 92 for supplying developer, an image input section 67 for receiving image data to be printed from outside, an operation panel 68 for accepting settings as to number of copies to be printed, paper size, etc. and for accepting printing instructions, and a detector 93 for detecting the temperature and humidity outside the image forming apparatus 1. At shipment, the image forming apparatus 1 contains an amount GS (see FIG. 5) of developer inside the developing device 2. The rotation speed of the second stirring member 44 can be switched between rotation rate H (third speed) and rotation rate L (second speed), and rotation rate L is lower than rotation rate H. The rotation speed of the second stirring member 44 is set at rotation rate L during image formation to cope with the printing speed of a low-speed apparatus, and is set at rotation rate H when excess developer is forcibly discharged.

The controller 70 is composed of a microprocessor, a storage device such as RAM and ROM, a counter for counting time for various control purposes, etc. According to programs and data set in the storage device, and based on information entered via the image input section 67 and the operation panel 68, the controller 70 controls the drive circuit 78 and the container drive circuit 91. The controller 70 includes a printing ratio calculator 72, a supply amount calculator 73, a total supply amount calculator 74, a drive controller 75, a first reference table 81, a second reference table 82, and a third reference table 83, and is switchable between an image formation mode and a forcible discharge mode, the latter being a mode for forcibly discharging the developer inside the developing device 2.

The first reference table 81 stores, for example, data on the ratio of the amount of toner consumed to a given printing ratio on an A4-size paper P and data on the ratio of the amount of carrier to the toner in the supplied developer. The second reference table 82 stores data on the total amount of supplied developer at which to switch to forcible discharge mode. For example, in the embodiment, as the total amount of supplied developer at which to switch to forcible discharge mode, there are stored amounts starting with 200 g and increasing in increments of 20 g, namely, 220 g, 240 g, 260 g, . . . . The third reference table 83 stores, as shown in Table 1, different temperatures and humidities, absolute humidities, bulk densities of the developer, and rotation rates of the second stirring member 44 in association among them.

On receiving an instruction to print from the operation panel 68, the printing ratio calculator 72 calculates, based on the image data fed from the image input section 67, the ratio (printing ratio) of the data, such as characters, to be printed to the entire area of the sheet to be subjected to image formation.

The supply amount calculator 73 calculates, according to the printing ratio, the developer supply amount to the developing device 2 (the amount of developer to be supplied to the developing device 2). Specifically, based on the printing ratio fed from the printing ratio calculator 72, the print paper size entered via the operation panel 68, and the toner consumption amount for a given printing ratio and the carrier-to-toner ratio in the supplied developer stored in the first reference table 81, the supply amount calculator 73 calculates the amount of developer to be supplied for each sheet of paper P. Next, the supply amount calculator 73 feeds the container drive circuit 91 with a rotation drive signal such that the calculated amount of developer will be supplied. Based on the rotation drive signal, the container motor 92 rotates a predetermined number of turns so that a predetermined amount of developer is supplied to the developing device 2. The supply amount calculator 73 feeds the calculated developer supply amount to the total supply amount calculator 74.

The total supply amount calculator 74 calculates the total supply amount of developer supplied to the developing device 2. Then, each time the calculation result reaches the total developer supply amount stored in the second reference table 82, the total supply amount calculator 74 feeds the drive controller 75 with a switching signal for switching from image formation mode to forcible discharge mode.

The drive controller 75 is for controlling the drive circuit 78 for driving the stirring motor 65, and outputs to the drive circuit 78 either a low-speed drive enable signal or a high-speed drive signal. In image formation mode, the low-speed drive enable signal is output, and in forcible discharge mode, the high-speed drive signal is output. When the low-speed drive enable signal is output from the drive controller 75, the drive circuit 78 enables the stirring motor 65 to be driven at low speed, and this makes the second stirring member 44 ready to rotate at rotation rate L. On the other hand, when the high-speed drive signal is output from the drive controller 75, the drive circuit 78 forcibly drives the stirring motor 65 at high speed, and this makes the second stirring member 44 rotate at rotation rate H. At shipment, the image forming apparatus 1 is so set that the drive controller 75 outputs the low-speed drive enable signal to the drive circuit 78; thus, unless the mode is switched to forcible discharge mode and the high-speed drive signal is fed in, image formation mode is maintained in which the stirring motor 65 can be driven at low speed. In image formation mode, when an instruction to print is fed to the drive controller 75 via the operation panel 68, the drive circuit 78 drives the stirring motor 65 at low speed. As the stirring motor 65 is driven, the second stirring member 44 rotates at rotation rate L, and the developing roller 20 and the photosensitive member 11 are driven to rotate, thus achieving image formation.

The output of the switching signal from the total supply amount calculator 74 makes execution of forcible discharge mode possible. In forcible discharge mode, the drive controller 75 switches from the low-speed drive enable signal to the high-speed drive signal, and feeds the high-speed drive signal to the drive circuit 78 for the first period (in the embodiment, 100 seconds). Based on the high-speed drive signal, the drive circuit 78 forcibly makes the stirring motor 65, which has been enabled to be driven at low speed since the shipment of the image forming apparatus 1, rotate at high speed, and makes the second stirring member 44 rotate at rotation rate H for the first period. As a result of the second stirring member 44 being driven to rotate at rotation rate H for the first period, the developer inside the developing device 2 is gradually discharged to the developer discharge portion 221, until, at the lapse of the first period, the amount of developer inside the developing device 2 becomes equal to amount GH. Forcible discharge mode does not hamper image formation so long as it is executed when no image formation is being performed (during a non-image-formation period), as after the completion of image formation by the developing device 2 or while the image forming apparatus 1 is in a sleep mode. For example, it is possible not to switch to forcible discharge mode even when the total amount of developer supplied has reached a predetermined amount if in the middle of a continuous printing operation, but to switch to forcible discharge mode on completion of the continuous printing operation.

After the drive circuit 78 has made the stirring motor 65 rotate at high speed for the first period in forcible discharge mode, the mode is switched to image formation mode, and the drive controller 75 then outputs the low-speed drive enable signal to the drive circuit 78. The second stirring member 44 is ready to rotate at rotation rate L, and thus, on receiving an instruction to print from the operation panel 68, the drive circuit 78 drives the stirring motor 65 at low speed. As the stirring motor 65 is driven to rotate, the developing device 2 and the photosensitive member 11 are driven, and thus image formation is performed. As image formation proceeds, developer is supplied and, each time the total developer supply amount increases by 20 g, the stirring motor 65 is forcibly made to rotate at high speed for the first period in forcible discharge mode, so that the second stirring member 44 rotates at rotation rate H for the first period. In the forcible discharge mode, the drive controller 75 corrects rotation rate H (third speed) based on the temperature and humidity data fed from the detector 93 and the third reference table 83, and drives the second stirring member 44 to rotate at the corrected rotation rate H. Thus, the amount of developer inside the developing device 2 stays equal to or larger than the mid value Gc but equal to or smaller than the upper limit value Gb of the adequate range. In this way, even when a single type of developing device 2 is used in a plurality of types of image forming apparatuses 1 including high-speed and low-speed apparatuses, a satisfactory image can always be obtained.

In the embodiment, as described above, the controller 70 switches the rotation speed of the second stirring member 44 from rotation rate L to rotation rate H, drives the second stirring member 44 to rotate at rotation rate H for a first period (for example, 100 seconds), and rotation rate H is set higher the lower the fluidity of developer. Thus, when the fluidity of developer lowers, the second stirring member 44 can be driven to rotate at higher speed, and thus it is possible to suppress degradation in the discharge properties of developer. It is thus possible to keep the amount of developer inside the developing device 2 at a desired value.

Moreover, as described above, the controller 70 sets rotation rate H according to temperature and humidity. Since the fluidity of developer depends particularly on temperature and humidity, varying rotation rate H according to temperature and humidity is particularly effective.

Moreover, as described above, the detector 93 detects the temperature and humidity outside the image forming apparatus 1. The temperature and humidity inside the developing device 2 tend to vary greatly during the use of the image forming apparatus 1 under the influence of devices (such as the fusing section 18) around the developing device 2. In the embodiment, the detector 93 detects the temperature and humidity outside the image forming apparatus 1, and this helps reduce the influence of devices around the developing device 2 and improve the accuracy of detection of temperature and humidity. As the detector 93, one commonly provided in a conventional image forming apparatus is shared also for correction of rotation rate H (third speed), and thus no increase in the number of components or in the complexity of apparatus structure is involved.

Moreover, as described above, when the controller 70 has driven the second stirring member 44 to rotate at rotation rate L for the second period (the time required for the total developer supply amount to increase by 20 g), it then drives the second stirring member 44 at rotation rate H for the first period. In this way, for example, in a case where the number of sheets printed continuously is small (the time for which the second stirring member 44 is driven to rotate at rotation rate L is short), no discharge of excess developer is performed, and this helps reduce the total number of times and the total length of time that discharging operation is performed.

In the present specification and the appended claims, what is referred to as the "second period" is a conception covering not only a length of time measured by a time counting portion such as a timer but also a "length of time required for the developer supplied to the developing device to reach a predetermined amount," a "length of time for the number of printed sheets to reach a predetermined number," a "length of time for a stirring member to rotate a predetermined number of turns," etc.

Moreover, as described above, the second period is determined based on the amount of developer supplied. It is thus possible to accurately control the amount of developer inside the developing device 2 when switching the rotation speed of the second stirring member 44 to rotation rate H.

Moreover, as described above, forcible discharge mode is executed during a non-image-formation period after execution of image formation mode. This makes it possible to discharge the developer inside the developing device 2 without affecting image formation.

It should be understood that the embodiment disclosed herein is in every respect illustrative and not restrictive. The scope of the present disclosure is defined not by the description of the embodiment given above but by the appended claims, and encompasses any modifications and variations made in the sense and scope equivalent to those of the claims.

For example, although the above-described embodiment deals with a tandem-type color printer as shown in FIG. 1, this is not meant to be any limitation. The present disclosure is applicable to a variety of image forming apparatuses provided with a developing device that is supplied with two-component developer containing toner and carrier while discharging excess developer, examples of such image forming apparatuses including digital and analog monochrome copiers, color copiers, monochrome printers, and facsimile machines.

Although the above-described embodiment deals with an example where a developing device provided with a magnetic roller between a stirring member and a developing roller is used, this is not meant to limit the present disclosure. A developing device provided with no magnetic roller can instead be used.

Although the above-described embodiment deals with an example where, when the developing device 2 is used in a low-speed apparatus, excess developer is discharged forcibly, this is not meant to limit the present disclosure. It is also possible, when the developing device 2 is used in a high-speed apparatus that allows switching of the printing speed, to discharge excess developer forcibly. Specifically, even in a high-speed apparatus, the rotation speed of the second stirring member 44 can be switched to rotation rate L depending on type of paper, such as thickness, and print mode, such as high-gloss printing. In that case, as in a case where the developing device 2 is used in a low-speed apparatus, the amount of developer inside the developing container 22 gradually increases, and thus the rotation speed of the second stirring member 44 can be switched to rotation rate H to discharge excess developer forcibly.

Although the above-described embodiment deals with an example where rotation rate H is corrected according to temperature and humidity, this is not meant to limit the present disclosure. The fluidity of developer is influenced by the driving time of the developing device 2 and the printing ratio of the images printed on paper P, and therefore it is also effective to correct rotation rate H according to the driving time of the developing device and the printing ratio. Specifically, the longer the driving time of the developing device 2, the lower the fluidity of developer tends to be. Thus, rotation rate H can be corrected to be higher the longer the driving time of the developing device 2. Also, continuous printing of images with low printing ratios permits replacement of only a small portion of toner, and this tends to cause deterioration of toner and lower the fluidity of developer. Thus, rotation rate H can be corrected to be higher the lower the printing ratio. As the driving time of the developing device 2, it is preferable to use the total driving time since the initial state of the developing device 2 (its state as it was brand-new), but it is also possible to use the drive time in a predetermined period of time (for example, the period after the previously done forcible discharge). As the printing ratio, it is preferable to use the average printing ratio in a predetermined period of time (for example, the period after the previously done forcible discharge), but it is also possible to use the average printing ratio since the initial state of the developing device 2 (its state as it was brand-new).

Although the above-described embodiment deals with an example where the temperature and humidity outside the image forming apparatus 1 are detected to correct rotation rate H, this is not meant to limit the present disclosure. The temperature and humidity around or inside the developing device 2 can instead be detected to correct rotation rate H.

Although the above-described embodiment deals with a structure where the reverse helical blade 52 for restricting the amount of developer discharged is provided integrally with the second stirring member 44 and is arranged between the second helical blade 44*a* and the developer discharge port 22*h*, this is not meant to limit the present disclosure. A restricting member for restricting the amount of developer discharged can be provided separately from the second stirring member 44, or can be a flat plate stationarily provided to face the developer discharge port 22*h* and so structured that a predetermined amount of developer crosses over it.

What is claimed is:

1. An image forming apparatus including a developing device which is supplied with developer containing toner and carrier while discharging excess developer to outside, and a controller which controls the developing device, wherein the developing device includes:

a developer carrier which carries the developer on a surface thereof;

a stirring member which can rotate at a first speed or at a second speed lower than the first speed, the stirring member feeding the developer stirred and transported inside the developing device to the developer carrier, the stirring member varying, according to rotation speed thereof, an amount of developer discharged out of the developing device; and a developer discharge portion which discharges the excess developer out of the developing device, the controller drives the stirring member to rotate at the second speed, then switches the rotation speed of the stirring member from the second speed to a third speed higher than the second speed but lower than the first speed, and then drives the stirring member to rotate at the third speed for a first period required for an amount of developer in the developing device to fall to a first predetermined amount, and the third speed is set higher the lower fluidity of the developer is.

2. The image forming apparatus according to claim 1, wherein the controller sets the third speed according to at least one of a combination of temperature and humidity, driving time of the developing device, and printing ratio of an image printed on a recording medium.

3. The image forming apparatus according to claim 2, further including a detector which detects temperature and humidity outside the image forming apparatus, wherein the controller sets the third speed according to the temperature and humidity detected by the detector.

4. The image forming apparatus according to claim 1, wherein, when the controller has driven the stirring member to rotate at the second speed for a period equal to or longer than a second period required for the amount of developer supplied to the developing device to reach a second predetermined amount, the controller then drives the stirring member to rotate at the third speed for the first period.

5. The image forming apparatus according to claim 4, wherein the second period is determined based on an amount of developer to be supplied.

6. The image forming apparatus according to claim 1, wherein the controller can switch between an image formation mode in which the stirring member is driven to rotate at the first speed or at the second speed and a forcible discharge mode in which the stirring member is driven to rotate at the third speed to forcibly discharge the developer inside the developing device, and the forcible discharge mode is executed during a non-image-formation period after execution of the image formation mode in which the stirring member is driven to rotate at the second speed.

* * * * *